US005853024A

United States Patent [19]

Life

[11] Patent Number: 5,853,024

[45] Date of Patent: Dec. 29, 1998

[54] TOP-MOUNTABLE WIDESPREAD VALVE BODY

[75] Inventor: James W. Life, Mission Viejo, Calif.

[73] Assignee: Perani, Inc., Agoura Hills, Calif.

[21] Appl. No.: 892,409

[22] Filed: Jul. 14, 1997

[51] Int. Cl.[6] ..... F16K 24/02

[52] U.S. Cl. ..... 137/359; 137/360

[58] Field of Search ..... 137/359, 360; 251/218

[56] References Cited

U.S. PATENT DOCUMENTS 2,818,878 1/1958 Russell ..... 137/359

4,553,560 11/1985 Tucker et al. ..... 137/359

5,535,776 7/1996 Kingman ..... 137/359

FOREIGN PATENT DOCUMENTS

WO88/00263 6/1987 WIPO .

*Primary Examiner*—A. Michael Chambers

*Attorney, Agent, or Firm*—Harry G. Weissenberger

[57] ABSTRACT

A one-piece, leakproof, top-mountable valve body for lavatories which has a uniform, screwthreaded outer diameter and parallel inlet and outlet ports in its bottom surface.

8 Claims, 4 Drawing Sheets

TOP-MOUNTABLE WIDESPREAD VALVE BODY

FIELD OF THE INVENTION

This invention relates to water valves for lavatories or the like, and more particularly to a top-mountable valve in which the valve body and valve seat are formed as a single piece.

BACKGROUND OF THE INVENTION

Water valves for regulating the water flow to a spout, as for example in a kitchen or bathroom sink, typically include a valve body which defines a water inlet conduit and a water outlet conduit, and a valve assembly which contains a valving element that can be operated by a handle to open and close a water path between the inlet and outlet conduits. The valve assembly typically screws into the valve body and seats against a valve seat. Conventionally, the valve seat is the rim of a separate hollow stem which is screwthreadedly connected to the valve body and is open to the water inlet.

There are two disadvantages to this conventional construction. One is that the two-piece construction is a potential source of leaks at the screwthreaded connection of the valve seat stem to the valve body; the other is that the valve body typically requires a lateral connection of the outlet line to the valve body. This in turn requires installation of the valve from the underside of the lavatory, which makes it difficult to properly align the escutcheon with the handle in a vertical direction.

SUMMARY OF THE INVENTION

The present invention overcomes the disadvantages of the prior art by providing a one-piece valve body of uniform outer diameter, in which both the inlet and outlet ports are in the bottom surface of the valve body, and in which there is no possible leakage path between the water inlet and outlet except by way of the valve seat and the valve assembly cooperating with it.

DESCRIPTION OF THE PREFERRED EMBODIMENT

Figure 1:
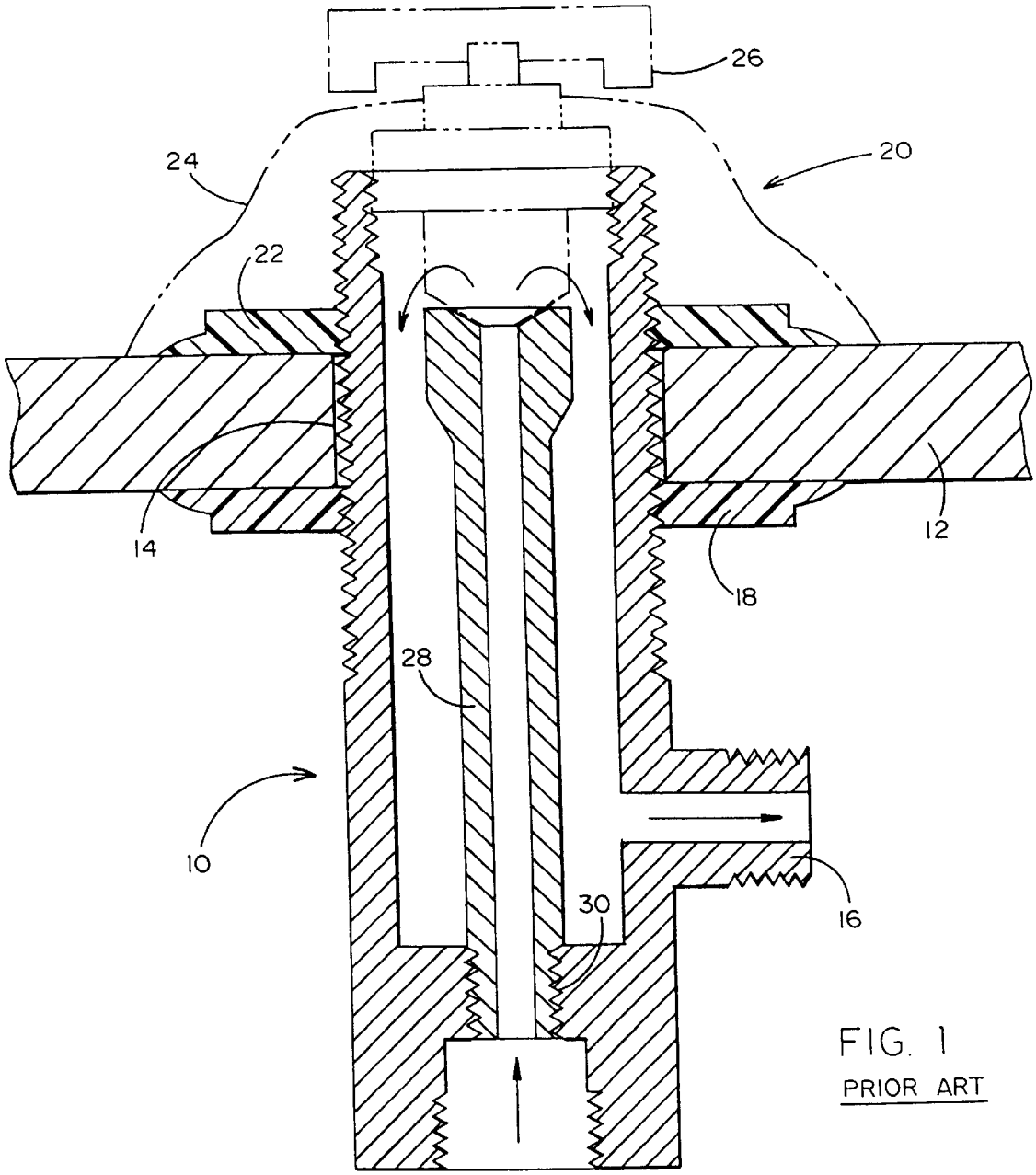
FIG. 1 PRIOR ART
FIG. 1 is a vertical section of a prior art valve.
Figure 2:
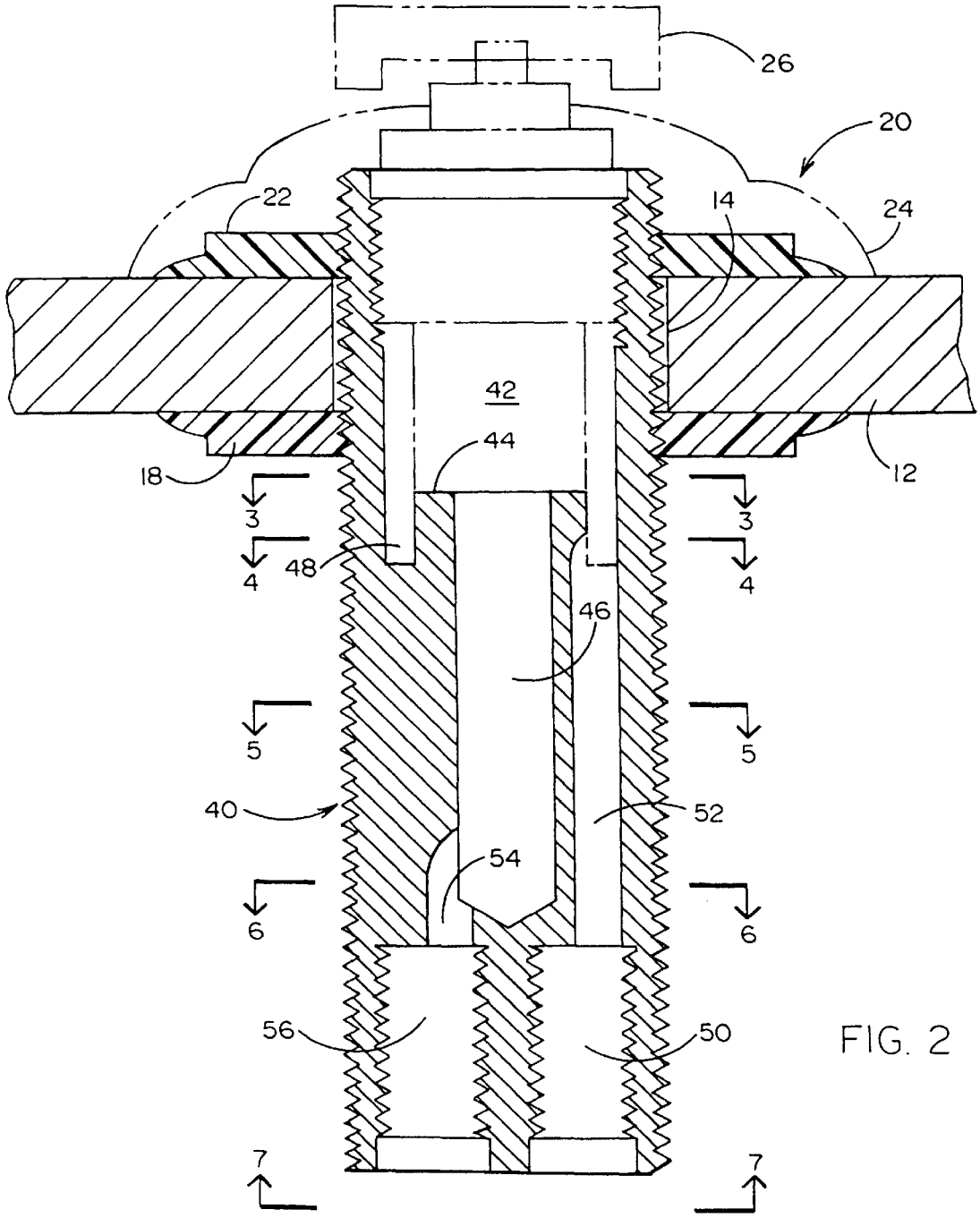
FIG. 2 is a vertical section of the valve of this invention.
Figure 3:
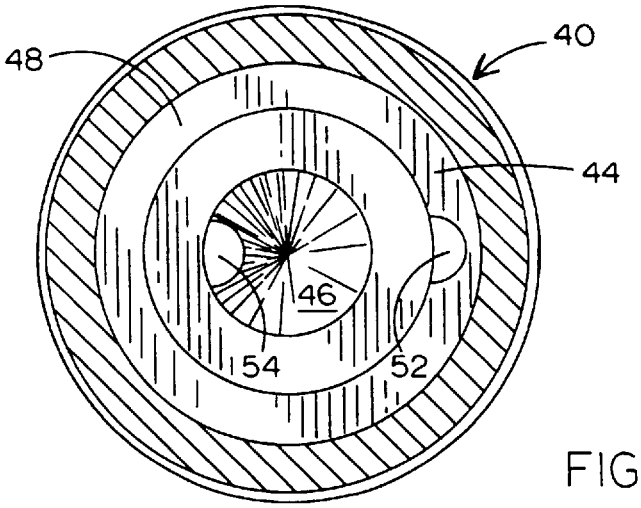
FIG. 3 is a section along line 3—3 of FIG. 2.
Figure 4:
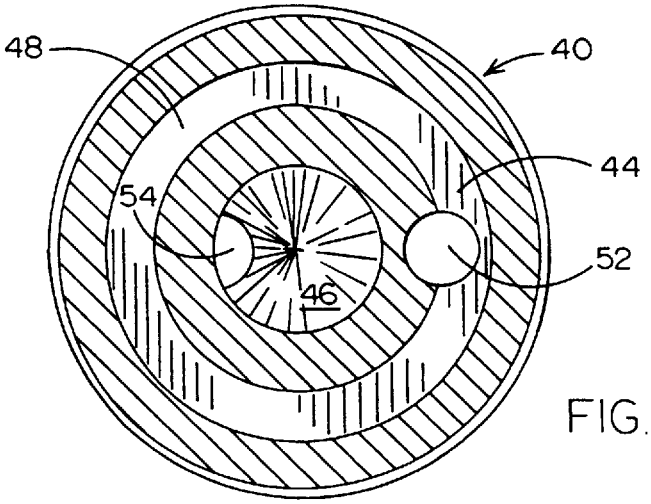
FIG. 4 is a section along line 4—4 of FIG. 2.
Figure 5:
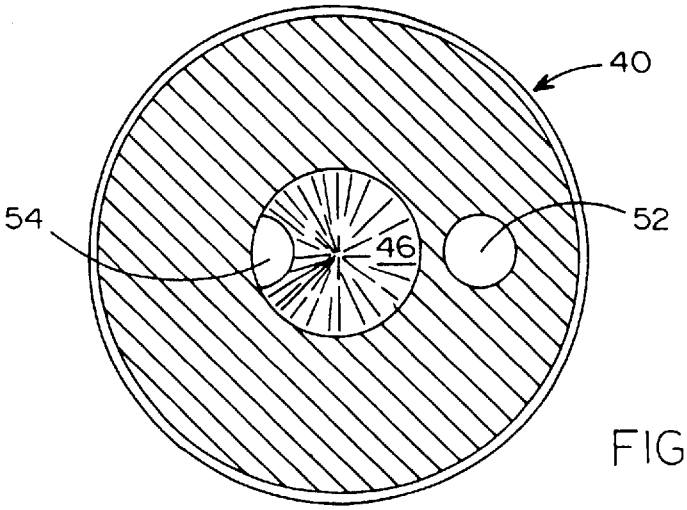
FIG. 5 is a section along line 5—5 of FIG. 2.
Figure 6:
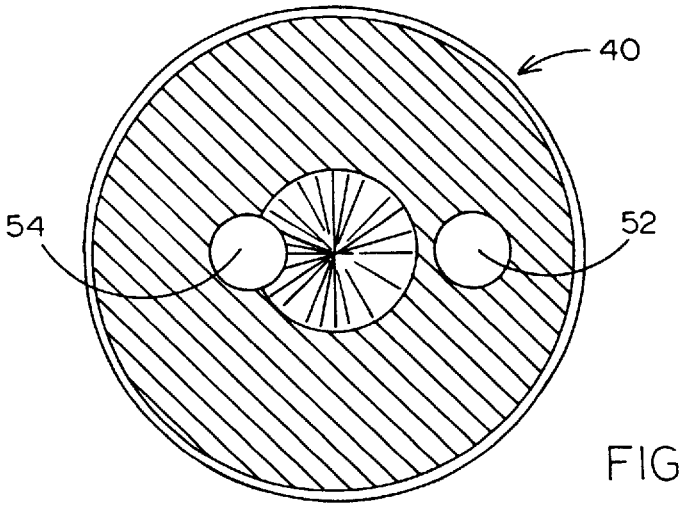
FIG. 6 is a section along line 6—6 of FIG. 2.
Figure 7:
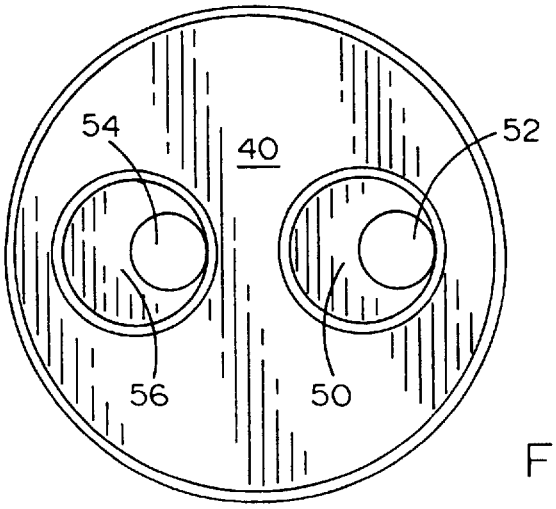
FIG. 7 is a bottom view of the valve body of FIG. 2.

FIG. 1 illustrates the prior art problems which the present invention is intended to solve. In order to mount a conventional valve body 10 in a lavatory 12, the valve body 10 must be inserted through the opening 14 in the lavatory 12 from the bottom, because the outlet nipple 16 will not pass through the opening 14. Prior to installation, the flanged screwthreaded bottom nut 18 is screwed onto the the valve body 10 to a height which is expected to be approximately correct for the subsequent mounting of the valve assembly 20.

When the valve body 10 has been passed through the opening 14 to the level where bottom nut 18 contacts the underside of the lavatory 12, the installer must hold the valve body 10 in that position while reaching around the front of the lavatory 12 and screwing the flanged top nut 22 onto the valve body 10 until it contacts the top side of the lavatory 12. The valve assembly 20 (shown in phantom because its exact nature is not relevant to the structure of the valve body 10) can then be screwed into the valve body 10.

Because the positioning of the bottom nut 18 is often an educated guess, it is not uncommon for the valve body 10 to end up in a position that is too high or too low for the escutcheon 24 and the handle 26 to be properly fitted to the lavatory 12 and to each other.

Awkward adjustment of the nuts 18 and 22 is then necessary.

Another problem with the prior art valve body 10 is that for manufacturing reasons, the hollow valve stem 28 must be fabricated as a separate piece and screwed into the valve body 10 at 30. The screwthreads 30 are a potential source of leaks that cannot be repaired without disassembling the valve body 10.

FIGS. 2–7 show the one-piece, top-mountable valve body 40 of this invention. The uniformly cylindrical, externally screwthreaded barrel 40 of the inventive valve body has formed therein a hollow valve chamber 42 which receives the valve assembly 20. The valve assembly 20, when screwed into the barrel 40, seats against the valve seat 44. The valve seat 44 is defined by a central bore 46 and a shallow annular channel 48. The central bore 46 preferably extends through most, but not all, of the length of the barrel 40. The channel 48 communicates with the outlet port 50 on the bottom surface of the barrel 40 through an axially extending but radially offset bore 52. A short second axially extending but radially offset bore 54 connects the inlet port 56 on the bottom surface of the body 40 to the lower end of the central bore 46. The diameter and position of bore 54 are such that the bore 54 communicates with the central bore 46 along the axial distance through which they are present side by side.

The valve body 40 of this invention considerably facilitates the installation of the valve. The top nut 22, escutcheon 24 and valve assembly 20 are first assembled with the valve body and are vertically aligned for a correct fit. The inventive valve body is then inserted into the opening in lavatory 12 from the top. Because the barrel 40 is supported in the opening 14, the bottom nut 18 can now be screwed on and tightened from the underside of lavatory 12 without reaching around the edge of lavatory 12, and the inlet and outlet pipes (not shown) can be connected to their respective ports 56, 50.

The one-piece construction of the barrel 40 results in a considerable cost saving in the manufacture of the inventive valve body, and it furthermore eliminates the possibility of an internal leak between the inlet 56 and the outlet 50 as long as the valve assembly 20 seats properly on the valve seat 44.

It is understood that the exemplary top-mountable widespread valve body described herein and shown in the drawings represents only a presently preferred embodiment of the invention. Indeed, various modifications and additions may be made to such embodiment without departing from the spirit and scope of the invention. Thus, other modifications and additions may be obvious to those skilled in the art and may be implemented to adapt the present invention for use in a variety of different applications.

I claim:

1. A valve body for lavatory valves, comprising:

a) a substantially cylindrical barrel;

b) a water inlet and a water outlet both formed on the bottom surface of said barrel;

c) valve chamber formed in said barrel at its top end;

d) a first bore extending axially downwardly from said valve chamber and being in fluid communication with said water inlet;

e) an annular channel surrounding said first bore, said channel being open to said valve chamber;

f) said bore and said channel defining between them a valve seat; and g) a second bore extending axially of said barrel from said water outlet to said channel.

2. The valve body of claim 1, in which said fluid communication between said first bore and said water inlet is by way of a third bore extending axially upwardly from said water inlet at the bottom of said barrel, said third bore being of such diameter that it communicates with said first bore wherever it is axially coextensive therewith.

3. The valve body of claim 1, wherein said barrel has a substantially uniform outer diameter.

4. The valve body of claim 3, in which said barrel is externally screwthreaded throughout its length to receive mounting nuts for securing said barrel to a lavatory surface.

5. The valve body of claim 1, in which said barrel has a bottom surface, and said water inlet and outlet extend axially from said bottom surface on opposite sides of the axis of said barrel.

6. A valve body for lavatory valves, comprising:

a) a substantially cylindrical barrel having a bottom surface;

b) a valve chamber formed in said barrel at the top thereof;

c) first and second bores extending upwardly through a first portion of said barrel in a direction axial of said barrel, said bores being positioned on opposite sides of the axis of said barrel, said first and second bores constituting inlet and outlet connections, respectively;

d) a third bore extending downwardly from said valve chamber through a second portion of said barrel substantially coaxially with said barrel;

e) an annular channel formed around an upper portion of said third bore and substantially coaxially therewith, the portion of said barrel lying between said third bore and said channel forming a valve seat for said valve chamber;

f) a fourth bore extending in said barrel in a direction axial of said barrel between said second bore and said channel in fluid connection therewith; and g) a fifth bore extending in said barrel in a direction axial of said barrel between said first bore and said third bore in fluid connection therewith.

7. The valve body of claim 6, in which said fourth and fifth bores are on opposite sides of the axis of said barrel.

8. The valve body of claim 6, in which said first and second bores are internally threaded, and said barrel is externally threaded.

* * * * *